United States Patent [19]

Huenniger

[11] Patent Number: 4,749,166

[45] Date of Patent: Jun. 7, 1988

[54] DISCHARGE VALVE AND BAFFLE ASSEMBLY FOR A REFRIGERATION SYSTEM

[75] Inventor: Edward A. Huenniger, Liverpool, N.Y.

[73] Assignee: Carrier Corporation, Syracuse, N.Y.

[21] Appl. No.: 939,824

[22] Filed: Feb. 10, 1987

Related U.S. Application Data

[62] Division of Ser. No. 809,801, Dec. 16, 1985, Pat. No. 4,653,286.

[51] Int. Cl.[4] ..... F16K 31/42

[52] U.S. Cl. ..... 251/25; 251/30.01; 251/144; 137/907

[58] Field of Search ..... 251/144, 30.01, 25; 137/907; 62/174

[56] References Cited

U.S. PATENT DOCUMENTS 873,822 12/1907 Wolfe ..... 251/30.01 X 4,613,111 9/1986 Paquet et al. ..... 251/30.01 X

FOREIGN PATENT DOCUMENTS 726883 6/1932 France ..... 251/154

661457 11/1951 United Kingdom ..... 251/30.01

*Primary Examiner*—Arnold Rosenthal

*Attorney, Agent, or Firm*—David J. Zobkiw

[57] ABSTRACT

A discharge valve and baffle assembly is provided in a refrigeration system having either one or more compressors. The discharge valve and baffle assembly eliminates the effects of an established head upon starting the associated compressor, thereby permitting the compressor to quickly come up to speed for the established head. During compressor operation, the discharge valve and baffle assembly provides a suction force for holding the valve in the open position to prevent bouncing of the valve during part-load conditions and cycling of the valve between the open and closed positions during surge conditions. The assembly prevents backflow of refrigerant through the nonoperating compressor, and also provides a baffle effect to direct the flow of high pressure gaseous refrigerant uniformly into the condenser.

3 Claims, 3 Drawing Sheets

DISCHARGE VALVE AND BAFFLE ASSEMBLY FOR A REFRIGERATION SYSTEM

This application is a divisional application of Ser. No. 809,801, filed 12/16/85, now U.S. Pat. No. 4,653,286, dated 3/31/1987.

BACKGROUND OF THE INVENTION

This invention pertains to refrigeration systems, and more particularly to a discharge valve and baffle assembly for controlling the flow of high pressure gaseous refrigerant from a compressor to a condenser.

Most refrigeration systems include with the evaporator and condenser a single compressor for drawing low pressure gaseous refrigerant from the evaporator and compressing it to a higher pressure and then delivering the high pressure gaseous refrigerant to the condenser. During the operation of a refrigeration system, several undesirable transient conditions can occur. For example, in a centrifugal compressor one of these is a surge condition wherein the flow of refrigerant reverses, thereby decreasing efficiency of the refrigeration system and causing potential harm to various components therein.

Another undesirable transient condition with centrifugal compressors occur during startup of a multi-compressor system after it has been temporarily shut down for lack of a refrigerant load to be satisfied. At times, an established head exists during startup of one of the compressors, and this established head causes excessive torque requirements for starting the compressor. For example, in a centrifugal compressor, startup against an established head could prevent the compressor from coming to full speed.

Yet another undesired transient condition that exists is primarily associated with refrigeration systems having at least two compressors. The transient condition here is when one compressor is operating and the other is shut down. The operating compressor can cause backflow of refrigerant towards or through the shut down compressor. This condition can also exist in refrigeration systems having only a single compressor.

Current attempts to prevent the occurrence of these undesirable transient conditions include placing a discharge check valve between the compressor and condenser that attempts to eliminate effects of an established head on startup of a compressor, and to prevent backflow of refrigerant through a compressor.

Several disadvantages exist with some of these prior art discharge check valves. One such disadvantage is that the valve can violently slam between the open and closed positions in cyclical fashion during surge conditions. This tends to cause premature failure of the valve, and also creates undesirable noise during operation.

Another disadvantage with some of these current check valves is that they create a large and undesired pressure drop between the compressor and condenser due to the valve acting as an obstruction to refrigerant flow. The circuitous path the refrigerant must follow to flow through the valve creates the large pressure drop.

Another problem or failure of some prior art check valves is that they do not provide a baffle feature for the refrigerant flowing from the compressor to the condenser. This requires a separate baffle member to be constructed and disposed in the condenser to direct the incoming flow of high pressure gaseous refrigerant among, for example, the heat exchanger tubes in a shell and tube condenser.

SUMMARY OF THE INVENTION

It is an object of the present invention to provide an improved discharge valve for a refrigeration system.

Another object of the present invention is to provide a discharge valve and baffle assembly for a refrigeration system.

Yet another object of the present invention is to prevent cycling of the discharge valve under surge or part load conditions.

A further object of the present invention is to eliminate the effects of an established head on compressor startup.

A still further object of the present invention is to prevent backflow through a compressor.

Yet a further object of the present invention is to substantially eliminate large pressure drops between a compressor and a condenser.

Yet still a further object of the present invention is to provide a baffle feature in combination with a discharge valve.

In one form of the present invention there is provided a fluid discharge valve assembly comprising an inlet for receiving a flow of fluid, an outlet for delivering the flow of fluid, a valve member movable to close the outlet and to open the outlet, and a mechanism for releasably holding the valve member when at the open position.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
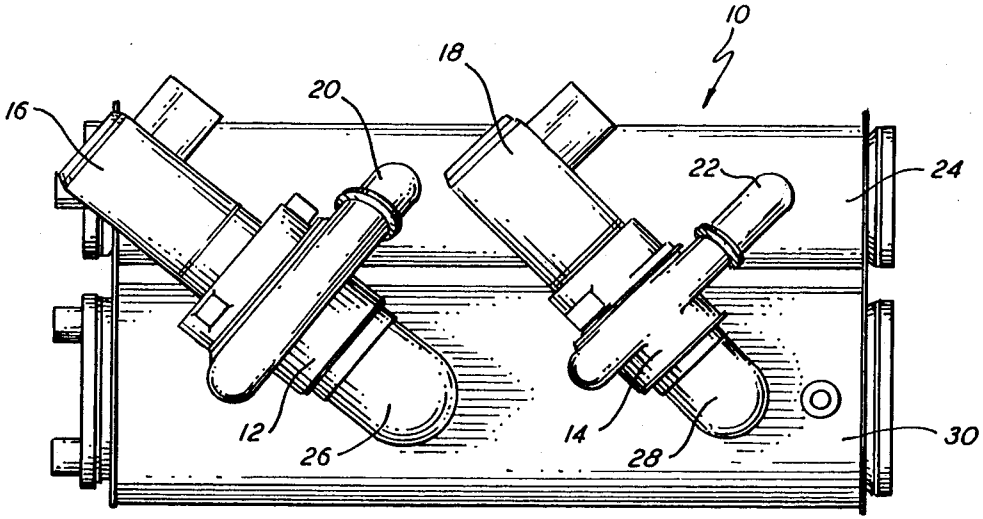
FIG. 1 is a schematic of a multi-compressor refrigeration system incorporating a preferred embodiment of the present invention.
Figure 2:
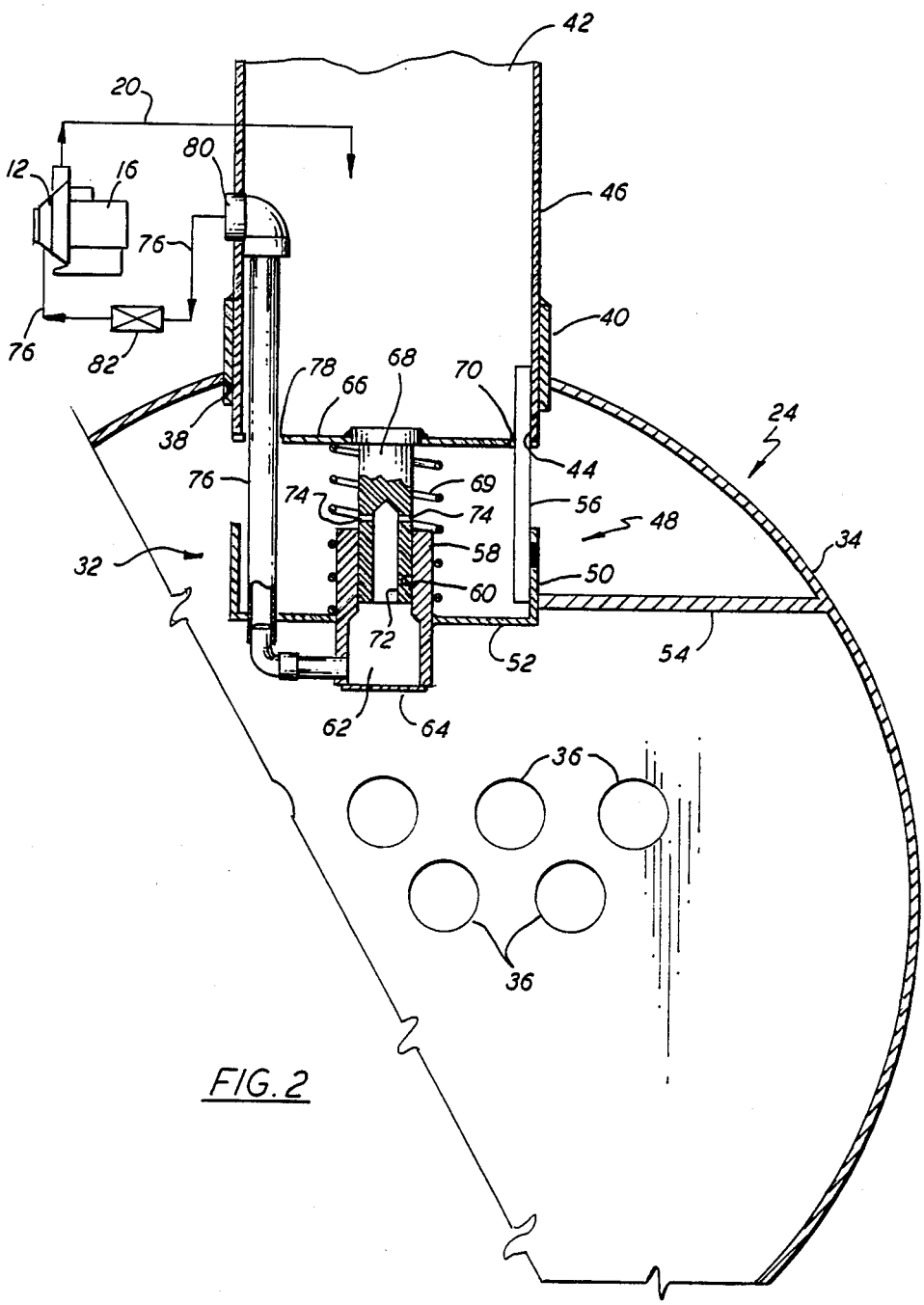
FIG. 2 is a sectional view of the preferred embodiment in the closed position incorporated in a condenser of a partially represented refrigeration system.
Figure 3:
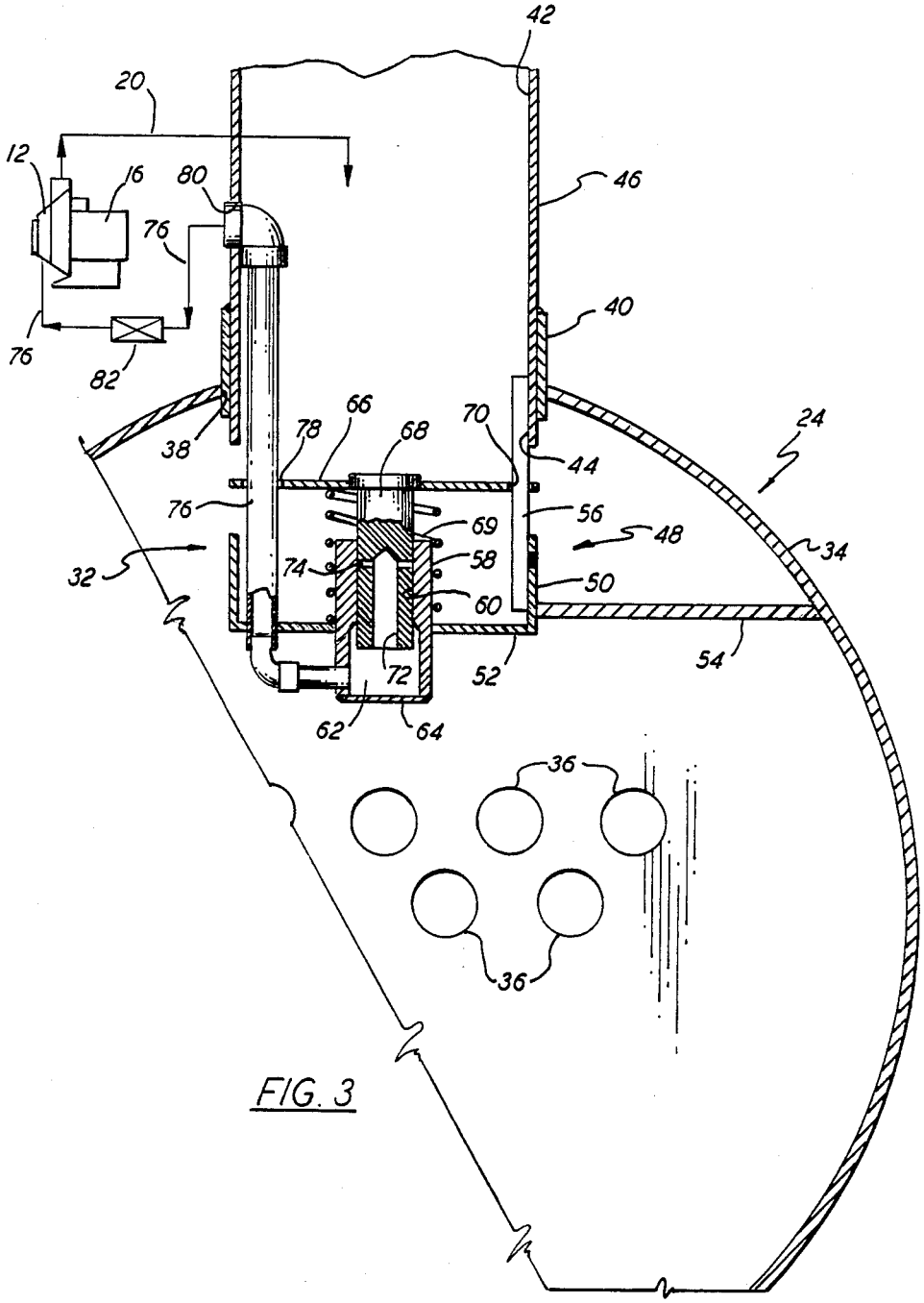
FIG. 3 is similar to FIG. 2 with the preferred embodiment in the open position.

Referring now to FIG. 1, there is illustrated multi-compressor refrigeration system 10 comprising two compressors 12, 14 driven by respective motors 16, 18. Compressors 12, 14 can be identical or different capacity compressors, and have their respective discharge lines 20, 22 connected in fluid communication with condenser 24. Similarly, compressors 12, 14 have their respective suction lines 26, 28 connected in fluid communication with evaporator 30. Although the present invention is described with reference to multi-compressor refrigeration system 10, the present invention contemplates use with a single compressor refrigeration system. Referring now to FIGS. 2 and 3, discharge valve and baffle assembly 32 of the present invention is illustrated in conjunction only with condenser 24 and compressor 12. A similar discharge valve and baffle assembly 32 could be provided with compressor 14, and since the function and structure are the same, the present invention will be described only with reference to compressor 12. Evaporator 30 is not shown in FIGS. 2 and 3, nor is an expansion device which is conventional with a typical refrigeration system. Condenser 24 includes shell 34 housing a plurality of heat exchanger tubes 36 supported therein and for delivering a fluid to be heated therethrough. Condenser 24 includes an opening 38 and into which is mounted discharge valve and baffle assembly 32. Assembly 32 is fitted and secured in a fluid tight manner in opening 38 by means of annular mounting support 40. The fluid tight fit can be provided in any suitable manner, such as by welding or the like.

Discharge valve and baffle assembly 32 comprises an inlet 42 connected in fluid communication with discharge line 20, and outlet 44 opening into the interior of condenser 24. Inlet 42 and outlet 44 comprise the opposite end portions of valve line 46 of the present invention.

Assembly 32 further comprises baffle and shield device 48 including a substantially continuous side wall 50 having one end thereof closed by end wall 52. Device 48 is spaced from and in alignment with outlet 44 of valve line 46. Device 48 is secured in position as illustrated in FIGS. 2 and 3 by two support arms 56 and suction pipe 76, which are spaced 120° apart. Pipe 76 is welded to end wall 52. A structural member 54 can also be used for additional support.

Secured in end wall 52 in any suitable manner is collar bearing 58, which has disposed therein open bore 60 opening into vent chamber 62. Vent chamber 62 is closed by end plate 64.

Assembly 32 further includes valve plate 66 mounted against outlet 44, as indicated in FIG. 2. Valve plate 66 is movable between this position where it closes outlet 44 and an open position, as indicated in FIG. 3, where it opens outlet 44. Joined to or integral with valve plate 66 is valve shaft 68 slidably received in bore 60. Valve plate 66 includes opening 70 for receiving support arm 66 therethrough. Preferably, the shape of opening 70 is complementary to and slightly greater than the shape of support arm 56, so as to provide a close sliding fit therewith. A spring 69 is received about collar bearing 58 and between end wall 52 and valve plate 66 for biasing plate 66 to the closed position.

Valve shaft 68 has disposed therein axial vent passage 72 and at least one radial vent passage 74 communicating with vent passage 72 and the interior of condenser 24 when valve plate 66 is in the closed position, as indicated in FIG. 2. Axial vent passage 72 opens into vent chamber 62. Suction pipe 76 is connected in communication with vent chamber 62 and passes through opening 78 in valve plate 66. The shape of opening 78 is complementary to and slightly larger than the shape of suction pipe 76, so as to provide a close sliding fit therewith. Suction pipe 76 passes through hole 80 in a fluid tight manner and leads to compressor 12. The opposite end of suction pipe 76 should be connected to a low pressure area, such as evaporator 30, the suction line 26, or behind the guide vanes (not shown) of compressor 12. As illustrated in FIGS. 2 and 3, suction pipe 76 leads to the suction side of compressor 12, and has coupled therein solenoid valve 82 for opening and closing suction pipe 76. Solenoid valve 82 is electrically connected with motor 16, so that when current is supplied to motor 16, current is also supplied to solenoid valve 82 for opening suction pipe 76. When current is terminated to motor 16, it is also terminated to valve 82 for closing suction pipe 76. Thus, on motor startup, solenoid valve 82 will open, and upon motor shutdown, valve 82 will close. Alternatively, valve 82 could be operated separately by a microcomputer (not shown) for the refrigeration system.

For purposes of explanation and in describing the operation of the present invention, compressor 14 will be operating and thus drawing gaseous refrigerant from evaporator 30, compressing the gaseous refrigerant, and then delivering the high pressure gaseous refrigerant to condenser 24.

Furthermore, compressor 12 is assumed to be shut down with valve plate 66 in the closed position as illustrated in FIG. 2. Valve plate 66 is biased to the closed position by spring 69. Furthermore, since motor 16 is not operating, solenoid valve 82 is de-energized and closes suction pipe 76. This permits equalization of pressure between the interior of condenser 24 and vent chamber 62 by means of axial vent passage 72 and radial vent passages 74. Note that in the closed position, radial vent passages 74 are open to communicate with the interior of condenser 24. However, when at the open position, as indicated in FIG. 3, radial vent passages 74 are substantially blocked off from communicating with condenser 24 by the interior side wall of bore 60.

Assuming now that the refrigerant load is such that it is necessary to bring compressor 12 on line, there is an established head existing by reason of operation of compressor 14. In order to eliminate the effects of the established head on compressor 12 during startup, valve plate 66 is maintained in the closed position by spring 69. Furthermore, communication of vent passages 72, 74 with condenser 24 prevents premature opening of valve plate 66 until compressor 12 has come up to speed. Thus, upon supplying current to motor 16, compressor 12 is quickly brought up to speed to match the existing head, and solenoid valve 82 is simultaneously energized with motor 16 for opening suction pipe 76.

For purposes of clarification, the definition or explanation of terms to be used hereinafter will be made. As in any refrigeration system, the compressor is a drawing or sucking source for drawing or sucking gaseous refrigerant from an evaporator. Thus, use of the terms "draw", "suck", "drawing", and "suction" are intended to be the same and interchangeable. Additionally, use of the word "vacuum" is not to mean an absolute vacuum, but rather a vacuum-like environment or state. Thus, the terms "vacuum", "vacuum-like", "near-vacuum", "partial vacuum", and "low pressure source" are intended to mean the same thing when used to describe a space that has had a substantial amount of its fluids evacuated therefrom.

Continuing to refer to FIG. 2, valve plate 66 will be held in a closed position by spring 69 until compressor 12 comes up to speed to provide a flow of high pressure gaseous refrigerant through discharge line 20 and inlet 42 sufficient to overcome the force of spring 69 and thus move valve plate 66 from the closed position to the open position, as illustrated in FIG. 3. Once in the open position, radial vent passages 74 are effectively blocked off from communicating with condenser 24 by the interior side wall of bore 60. Since solenoid valve 82 was energized with motor 16, suction pipe 76 communicates vent chamber 62 with a suction source, which in this description is the suction side of compressor 12 downstream of the guide vanes (not shown). Because of the suction effect provided thereby, vent chamber 62 is substantially evacuated of the presence of air or other fluid, thereby creating a vacuum-like or near-vacuum environment or state therein. The suction action provided by compressor 12 through vent chamber 62 and vent passages 72, 74 serves to draw or suck valve plate 66 downwardly to the open position as indicated in FIG. 3. The suction force provided by compressor 12 is greater than the force exerted by spring 69 to hold valve plate 66 in the open position.

Since the suction force provided by compressor 12 through suction pipe 76 and vent chamber 62 is sufficient to hold valve plate 66 in the open position against the force of spring 69, valve plate 66 does not cycle between the open and closed position during part load or surge conditions. This is particularly advantageous during surge conditions when reverse flow of refrigerant is experienced.

As indicated earlier, the use of terms such as "vacuum-like" or "near-vacuum" primarily intend to describe the pressure in vent chamber 62 as being much less than the high pressure environment within condenser 24, rather than an absolute vacuum therein.

During operation of compressor 12, valve plate 66 of baffle and shield device 48 acts as a baffle to direct the incoming flow of high pressure gaseous refrigerant away from direct impingement on heat exchanger tubes 36 and then to selected areas in condenser 24, thereby providing uniform flow over the length of heat exchanger tubes 36. Additionally, during surge conditions when reverse flow is experienced, baffle and shield device 48 serves to shield valve plate 66 against the force of the reverse flow, thereby assisting the suction force provided by compressor 12 in holding valve plate 66 in the open position during surge conditions.

Once the refrigerant load has been satisfied to the point that it is now desirable to shut down compressor 12, current flow is terminated to motor 16 and to solenoid valve 82 for closing suction pipe 76, thereby extinguishing the suction force provided by compressor 12. Since the suction force has been eliminated, and due to a designed amount of leakage permitted between valve shaft 68 and bore 60, the pressure within vent chamber 62 begins to rise to that of condenser 24, thereby permitting spring 69 to bias valve plate 66 from the open to the closed position.

Should suction pipe 76 lead to a point behind the inlet guide vanes (not shown) of compressor 12, and if the guide vanes are closed before shutting down compressor 12, then pressure in vent chamber 62 will rise to allow spring 69 to close valve plate 66. Under surge conditions, the pressure behind the inlet guide vanes will also rise to near condenser pressure, but this pressure will rise and fall in a short cyclic fashion. Proper sizing of suction pipe 76 and the clearance between valve shaft 68 and collar bearing 58 will prevent the pressure in vent chamber 62 from rising fast enough to allow valve plate 66 to move to the closed position.

Although discharge valve and baffle assembly 32 was described with reference to a multi-compressor refrigeration system 10, the present invention contemplates use in a single-compressor system. In the single compressor refrigeration system, it would be preferred to eliminate openings 70 and 78 in valve plate 66. In this case, support arm 56 would be mounted on the radially outer surfaces of valve line 46 and side wall 50, and suction pipe 76 would exit directly through shell 34, rather than through valve plate 66 and valve line 46. This alternate placement of support arm 56 and suction pipe 76 can also be made in multi-compressor refrigeration system 10. However, as illustrated in FIGS. 2 and 3, minimal leakage through openings 70, 78 does not adversely effect the performance of the present invention.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A fluid discharge valve assembly, comprising:

an inlet for receiving a flow of fluid therethrough, an outlet for delivering the flow of fluid therethrough, a valve member at said outlet, said valve member including a shaft member having disposed therethrough a vent passage having opposite open ends, and being movable between a closed position wherein said valve member closes said outlet and an open position wherein said valve member opens said outlet, means for releasably holding said valve member when at said open position, said releasable holding means including a bearing member having said shaft member slidably received therein, said shaft member having one of said open ends of said vent passage closed by said bearing member when at said open position and opened by said bearing member when at said closed position, and wherein said releasable holding means further includes a suction means connected to the other said open end of said vent passage in said shaft member for drawing fluid from within said vent passage when at said open position, whereby a vacuum-like state is created in said vent passage to hold said valve member when at said open position.

2. The assembly of claim 1 wherein said releasable holding means further includes a suction control means connected to said suction means for controlling said suction means to draw fluid from said vent passage when at said open position and to terminate drawing of fluid when at said closed position.

3. The assembly of claim 1 further comprising a baffle means disposed adjacent said outlet for selectively directing the flow of fluid.

* * * * *